US007424956B2

(12) United States Patent
Kohno

(10) Patent No.: US 7,424,956 B2
(45) Date of Patent: Sep. 16, 2008

(54) SEPARATION METHOD AND SEPARATION DEVICE

(75) Inventor: Motomi Kohno, Chiba-ken (JP)

(73) Assignee: ACO, Co., Ltd., Chiba-ken (JP)

( * ) Notice: Subject to any disclaimer, the term of this patent is extended or adjusted under 35 U.S.C. 154(b) by 547 days.

(21) Appl. No.: 10/766,477

(22) Filed: Jan. 29, 2004

(65) Prior Publication Data

US 2004/0187460 A1 Sep. 30, 2004

(30) Foreign Application Priority Data

Mar. 10, 2003 (JP) ..... 2003-063917
Apr. 18, 2003 (JP) ..... 2003-114144

(51) Int. Cl.
*B04C 5/00* (2006.01)
*B04C 5/12* (2006.01)
*B04C 5/13* (2006.01)

(52) U.S. Cl. ..... 209/721; 209/715; 209/710

(58) Field of Classification Search ..... 209/146, 209/154, 715, 716, 719, 722, 142, 143, 718, 209/720, 721, 723–725, 730, 732–734; 55/460, 55/459.1–459.5; 95/271
See application file for complete search history.

(56) References Cited

U.S. PATENT DOCUMENTS 2,917,173 A * 12/1959 Rakowsky ..... 209/172.5
3,667,600 A * 6/1972 Oi et al. ..... 20/139.2
3,753,336 A * 8/1973 Drew et al. ..... 96/228
4,201,256 A * 5/1980 Truhan ..... 144/252.2
4,214,982 A * 7/1980 Pfalzer ..... 209/164
4,221,655 A * 9/1980 Nakayama et al. ..... 209/135
4,292,172 A * 9/1981 Hosokawa et al. ..... 209/714
4,526,678 A * 7/1985 Myhren et al. ..... 209/2
4,678,588 A * 7/1987 Shortt ..... 210/788
4,776,950 A * 10/1988 Green et al. ..... 209/714
4,872,973 A * 10/1989 Ikebuchi et al. ..... 209/716
5,165,549 A * 11/1992 Kanda et al. ..... 209/135
5,938,045 A * 8/1999 Makino et al. ..... 209/713
6,568,536 B2 * 5/2003 Tanaka et al. ..... 209/139.2

FOREIGN PATENT DOCUMENTS

| | | |
|---|---|---|
| DE | 512672 | 11/1930 |
| GB | 850107 | 9/1960 |
| JP | 2002035699 | 2/2002 |

* cited by examiner

*Primary Examiner*—Patrick Mackey
*Assistant Examiner*—Mark Hageman
(74) *Attorney, Agent, or Firm*—Venable LLP; Michael A. Sartori; Steven J. Schwarz

(57) ABSTRACT

A method of the present invention separates lightweight grains from raw grains. In a primary separation step, raw grains containing the lightweight grains are whirled upward with primary air along the inner wall of the cylindrical section for allowing raw grains and part of the lightweight grains to stay in a certain flow area by frictional resistance with respect to the wall surface generated by whirl, and to drop into the conical section on the downside by their own weight. In a secondary separation step, secondary air is blown toward the raw grains dropping into the conical section in the primary separation step to blow the contained lightweight substances upward to the space in the cylindrical section. In a discharging step, raw grains with the lightweight grains removed are taken out from the conical section. A tertiary separation step for blowing the tertiary air may be added.

6 Claims, 12 Drawing Sheets

| DEVICE | A | | B | | D | | E | |
|---|---|---|---|---|---|---|---|---|
| PELLET THROUGHPUT | COLLECTED AMOUNT (g) | EFFICIENCY (%) | COLLECTED AMOUNT (g) | EFFICIENCY (%) | COLLECTED AMOUNT (g) | EFFICIENCY (%) | COLLECTED AMOUNT (g) | EFFICIENCY (%) |
| 0.42t/h | 36 | 72 | 47.5 | 95 | 50 | 100 | 39 | 78 |
| 0.6t/h | 31 | 62 | 47.75 | 95.5 | 50 | 100 | 36 | 72 |
| 1.2t/h | 27 | 54 | 47 | 94 | 50 | 100 | 26 | 52 |
| 2.2t/h | 25 | 50 | 46.7 | 93.4 | 50 | 100 | - | - |
| 2.7t/h | 23 | 46 | 47.5 | 95 | 50 | 100 | - | - |
| 3.0t/h | 22 | 44 | 47 | 94 | 50 | 100 | - | - |

FIG. 7
RATE OF SEPARATION OF RIBBONS
| AMOUNT OF AIR (Q) | SOLID-AIR RATIO (M) | FIRST TIME (g) | SECOND TIME (g) | A. V (g) | RATE OF SEPARATION (%) |
|---|---|---|---|---|---|
| $6m^3$/min | 5. 1 | – | – | – | – |
| $7m^3$/min | 4. 4 | 45 | 43 | 44 | 88% |
| $8m^3$/min | 3. 9 | 46 | 45 | 45. 5 | 91% |
| $9m^3$/min | 3. 4 | 47 | 46 | 46. 5 | 93% |
| $10m^3$/min | 3 | 48 | 47 | 47. 5 | 95% |
| $11m^3$/min | 2. 8 | 48 | 47 | 47. 5 | 95% |
FIG. 8
FLYING OF PELLETS
| AMOUNT OF AIR (Q) | SOLID-AIR RATIO (M) | FIRST TIME (g) | SECOND TIME (g) | A. V (g) | FLY RATE (%) |
|---|---|---|---|---|---|
| $6m^3$/min | 5. 1 | – | – | – | – |
| $7m^3$/min | 4. 4 | 8 | 6 | 7 | 0. 07% |
| $8m^3$/min | 3. 9 | 12 | 9 | 10. 5 | 0. 11% |
| $9m^3$/min | 3. 4 | 21 | 15 | 18 | 0. 18% |
| $10m^3$/min | 3 | 22 | 25 | 23. 5 | 0. 24% |
| $11m^3$/min | 2. 8 | 28 | 25 | 26. 5 | 0. 27% |
FIG. 9
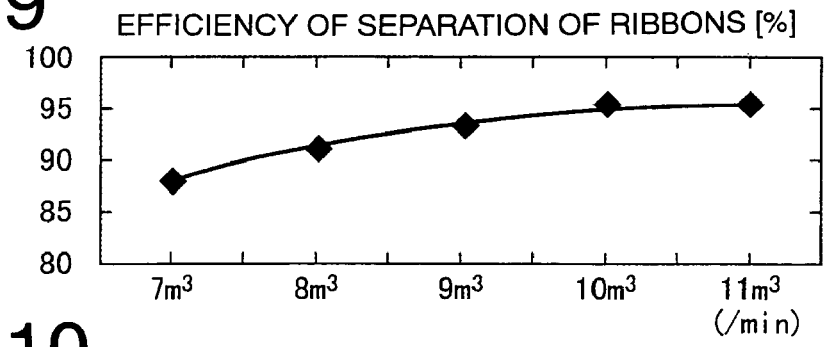
FIG. 10
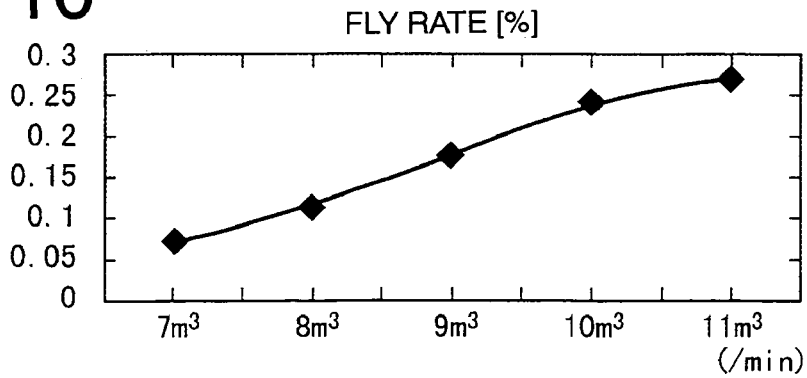

A-A SECTION

CAPACITY AND DATA

| TYPE | D | D1 EN-TRANCE | D2 EXHAUST AIR | D3 DIS-CHARGE | H (mm) | Q1 ($m^3$/min) | Q2 ($m^3$/min) | THROUGHPUT (kg/n) |
|---|---|---|---|---|---|---|---|---|
| CFS − 100 | 90A | 20A | 32A | 40A | 500 | 1.1 | 0.4 | 50~100 |
| CFS − 150 | 150A | 32A | 50A | 65A | 700 | 2.6 | 1.0 | 250~500 |
| CFS − 200 | 200A | 40A | 65A | 90A | 940 | 4.4 | 1.7 | 500~1000 |
| CFS − 250 | 250A | 50A | 80A | 100A | 1110 | 6.6 | 2.6 | 700~1400 |
| CFS − 300 | 300A | 65A | 100A | 125A | 1400 | 10 | 4 | 1150~2300 |
| CFS − 350 | 350 φ | 65A | 130 φ | 150A | 1580 | 12 | 4.8 | 1300~2600 |
| CFS − 400 | 400 φ | 80A | 125A | 150A | 1730 | 16 | 6.4 | 1600~3200 |
| CFS − 450 | 450 φ | 90A | 150A | 200A | 2000 | 20 | 8.0 | 2400~4800 |
| CFS − 500 | 500 φ | 100A | 180 φ | 200A | 2200 | 25 | 10 | 3000~6000 |
| CFS − 600 | 600 φ | 125A | 200A | 230 φ | 2650 | 36 | 14 | 4300~8600 |
| CFS − 700 | 700 φ | 125A | 225A | 270 φ | 3100 | 49 | 20 | 5.5t~11t/h |
| CFS − 800 | 800 φ | 150A | 280 φ | 310 φ | 3500 | 64 | 25 | 7.5t~15t/h |
| CFS − 900 | 900 φ | 175A | 300A | 350 φ | 4000 | 81 | 32 | 9.5t~19t/h |
| CFS − 1000 | 1000 φ | 200A | 350A | 390 φ | 4400 | 100 | 40 | 11t~22t/h |
| CFS − 1100 | 1100 φ | 200A | 380 φ | 430 φ | 4800 | 121 | 48 | 14t~28t/h |
| CFS − 1200 | 1200 φ | 225A | 420 φ | 470 φ | 5300 | 144 | 57 | 17t~34t/h |

(PRIOR ART)

SEPARATION METHOD AND SEPARATION DEVICE

BACKGROUND OF THE INVENTION

1. Field of the Invention

The present invention relates to a separation method for separating solid substances from each other, for example, a separation method for separating fine powder attached on a grain from the grain and, more specifically, a method of separating lightweight grains (flosses) from raw material including plastic pellets and flosses and the like or a method of separating bran from grain, and to a device for performing these methods.

2. Description of the Related Art

Plastic material for injection molding is provided in the state of pellets in many cases. While storing or transporting this material, filamentous or powdery, so-called, flosses or lightweight grains are generated by being broken or ground down by friction and thus are mixed with raw grains. When the material including such lightweight grains is stirred and heated, these grains melt out from the pellets. However, since flosses can hardly be melted, fine grains remain in the melted substance as foreign bodies.

For example, when molding a resin lens, the percentage of conforming articles is in the order of 80% due to the existence of such remaining foreign bodies. There may be a case in which the percentage of conforming articles is lower than 20% when the material contains the flosses even a little. Therefore, complete removal of the flosses is required, but it is difficult to remove the flosses completely with the device in the related art.

A device called "floss separator" for removing the flosses is known. FIG. 21 is a schematic drawing of this device. Resin material containing the flosses fed through a pneumatic transport pipe is injected by a feeding unit 17 into a cylindrical section 1 toward the inner wall of the pipe in the direction in which the pellets and the flosses rotationally move upward at a high-speed. An exhaust blower, not shown, is connected to an exhaust pipe 2 at the upper portion of the cylindrical section 1, and hence air and the flosses in the cylindrical section 1 are taken out via the exhaust pipe 2. On the other hand, the pellets move upward in whirling motion while rolling on the wall surface, and are separated from the flosses during this process. Consequently, the pellets move downward by gravity, and are taken out from the lower end of a conical section 3.

In general, when fine powder is contained in the grains, such fine powder may be separated by using a sieve. However, in the case where flosses are attached to the plastic pellets with electrostatic action, the flosses cannot be separated in the separation method in the related art described above.

In order to increase the rate of floss removal, an attempt has been made to increase the length H of the cylinder, or more specifically, the length of the portion of the device above the feeding unit 17. However, even with such configuration, it is still difficult to remove the flosses by 100%. Therefore, development of the method which can remove the flosses by 100% has been strongly required by those in charge of injection molding.

In the case where the flosses are attached to the plastic pellets by electrostatic action described above, that is, when fine grains are attached to the grains, there arises a problem in that when blowing the lightweight powder bodies upward by airflow to separate the powder bodies and grains, the grains are also blown upward. In particular, when the grains are light, they cannot be separated easily.

SUMMARY OF THE INVENTION

Accordingly, it is an object of the present invention to provide a method of separating lightweight grains (flosses) from raw grains (pellets) in which almost all the floss can be removed, or the floss can be removed completely.

It is another object of the invention to provide a device which can perform the method described above.

It is still another object of the invention to provide a method suitable for separating powder attached to the grains as described above.

It is further object of the invention to provide a device for performing the method described above.

In order to achieve the first object, in a first aspect of the present invention, there is provided a method of separating lightweight grains from raw grains using a vertical cylinder having, in the order from the top, an exhaust port, a cylindrical primary separation space, a conical secondary separation space, and an unloading port that is comprised of a primary separation step of introducing raw grains containing the lightweight grains, which are to be separated, together with primary air into the primary separation space in the direction to allow the material to whirl upward along the inner wall surface of the cylindrical section of the primary separation space, so that most of the lightweight substances contained in the raw grains are guided to the exhaust port by the upwardly flowing airflow in the pipe and the raw grains and part of the lightweight grains stay in a certain flow area by frictional resistance with respect to the wall surface generated by whirl and then are dropped into a secondary separation space by their own weight; a secondary separation step of blowing secondary air into the lower portion of the secondary separation space through a slit to the center toward the raw grains dropping into the conical section in the secondary separation space on the downside in the primary separation step so as to blow the lightweight substances in the raw grains upward to the primary separation space; and a discharging step of taking the raw grains with the lightweight grains removed continuously out from the unloading port at the lower portion of the conical section.

In a second aspect of the present invention, there is provided a method of separating lightweight grains from raw grains according to the above first aspect that is further comprised a tertiary separation step of blowing tertiary air from below the secondary air blowing position upwardly to blow remaining lightweight grains to the secondary separation space.

In order to achieve the second object, in a third aspect of the present invention, there is provided a device for implementing the method of the above first aspect that is comprised of a cylindrical section having an exhaust port at the upper portion thereof; a conical section provided below the cylindrical section; a raw grain feeding unit for feeding raw grains in the direction to whirl the raw grains upward along the inner periphery of the cylindrical section above the conical section; a lightweight grain separating unit for taking the lightweight grains in the raw grains out from the upper portion of the cylindrical section; a secondary air blowing unit for blowing the secondary air toward the raw grains being dropped from the cylindrical section upward at the lower portion of the conical section to move the fine grains upward to the cylindrical section; and a unit for discharging raw material from the lower portion of the conical section.

In a forth aspect of the present invention, there is provided a device according to the above third aspect, wherein the raw grain feeding unit is an upwardly oriented tangent induction pipe opening on the inner wall surface of the cylindrical section or an induction unit with spinner disposed at the center of the lower portion of the cylindrical section.

In a fifth aspect of the present invention, there is provided a device according to the above third aspect, wherein the secondary air blowing unit comprises a secondary air intake chamber connected via a slit provided at the lower end of the conical section for taking compressed air therefrom.

In a sixth aspect of the present invention, there is provided a device according to the above fifth aspect, wherein the secondary air blowing unit blows a high-speed secondary airflow from the slit toward a stabilizer provided at the lower end of the conical section.

In a seventh aspect of the present invention, there is provided a device according to the above sixth aspect, further comprising a tertiary air blowing unit, the tertiary air blowing unit blowing tertiary air from between the stabilizer and a unit for discharging the raw material toward the stabilizer.

In order to achieve the third object, in a eighth aspect of the present invention, there is provided a method of separating powder bodies and the like from grains using a vertical cylinder having, in the order from the top, an exhaust pipe, a cylindrical primary separation space, a secondary separation space, and an unloading port that is comprised of a primary separation step of introducing grains containing the powder bodies and the like, which is to be separated, together with primary air into the primary separation space in the direction of whirling along the inner wall surface of the cylindrical section of the primary separation space, moving most of the powder bodies and the like contained in the grains upward by airflow in the pipe, separating and discharging the powder bodies and the like from the exhaust pipe opening in the direction opposite to the whirling direction, and allowing the grains to drop into the secondary separation space by their own weights; a secondary separation step of blowing secondary air to the lower portion of the secondary separation space through a slit to the center toward the raw grains dropping into the conical section in the secondary separation space on the downside in the primary separation step so as to blow the remaining powder bodies and the like in the grains upward to the primary separation space; and a discharging step of taking the grains continuously out from an unloading port at the lower portion of the secondary separation space.

In a ninth aspect of the present invention, there is provided a method according to the above eight aspects that is comprised of a tertiary separation step of blowing tertiary air upward from below the secondary air blowing position to blow the remaining powder bodies and the like to the secondary separation space.

In order to achieve the forth object, in a tenth aspect of the present invention, there is provided a device for separating powder bodies and the like from grains that is comprised of a cylindrical section having an opening of an exhaust pipe for discharging the powder bodies and the like at the upper portion thereof; a conical section provided on the downside of the cylindrical section; a grain feeding unit for feeding grains containing the powder bodies and the like so as to whirl in the cylindrical section in the direction not opposing the opening of the exhaust pipe along the inner periphery of the cylindrical section; the secondary air blowing unit for blowing high-pressure air at the lower portion of the conical section from a circumferential slit on the conical section toward the grains containing the powder bodies and the like being dropped from the cylindrical section to move the powder bodies and the like upward to the cylindrical section; and a unit for discharging the grains from below the secondary air blowing unit.

In a eleventh aspect of the present invention, there is provided a device according to the above tenth aspect that is comprised the tertiary air blowing unit for blowing tertiary air from below the secondary air blowing unit.

In a twelfth aspect of the present invention, there is provided a device according to the above tenth aspect, wherein the secondary air blowing unit blows a high-speed secondary airflow toward a stabilizer provided at the lower end of the conical section from the slit. dr

BRIEF DESCRIPTION OF THE DRAWINGS

FIG. 7 is a table showing the rate of separation of the ribbons (flosses) corresponding to the amount of air for the device of the present invention provided with a stabilizer;

FIG. 8 is a table showing the flying rate of the pellets corresponding to the amount of air for the device of the present invention provided with the stabilizer;

FIG. 9 is a graph of the table shown in FIG. 7;

FIG. 10 is a graph of the table shown in FIG. 8;

DESCRIPTION OF THE PREFERRED EMBODIMENTS

An embodiment of the present invention will be described below. In addition to a method of separating by sucking air and row material (primary air usage), a method of the present invention basically employs a method of blowing air (secondary air) from below thereof. In order to realize better separation, a step of blowing air (tertiary air) further from below the secondary air blowing unit is provided.

Figure 1:
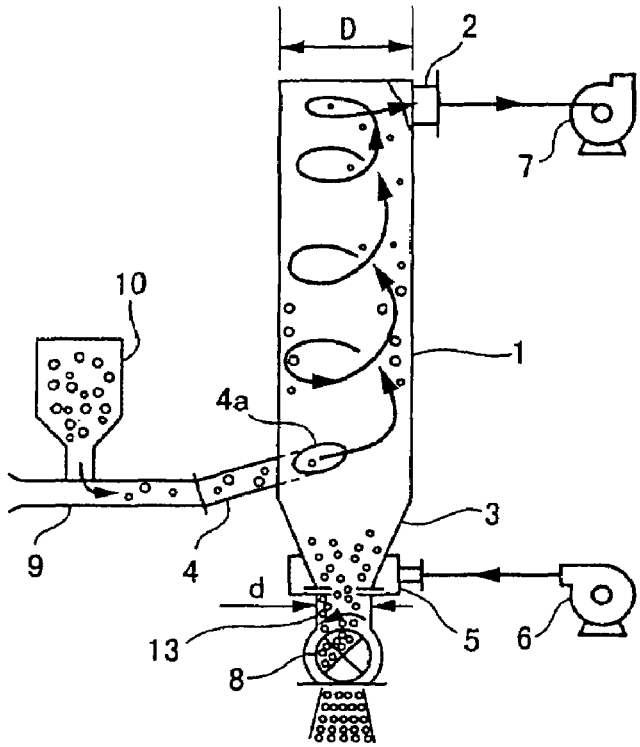
FIG. 1 is an explanatory schematic drawing showing a device according to a first embodiment, in which an upwardly oriented tangent induction pipe opening on the inner wall surface of the cylindrical section is employed as a raw grain feeding unit.
Figure 2:
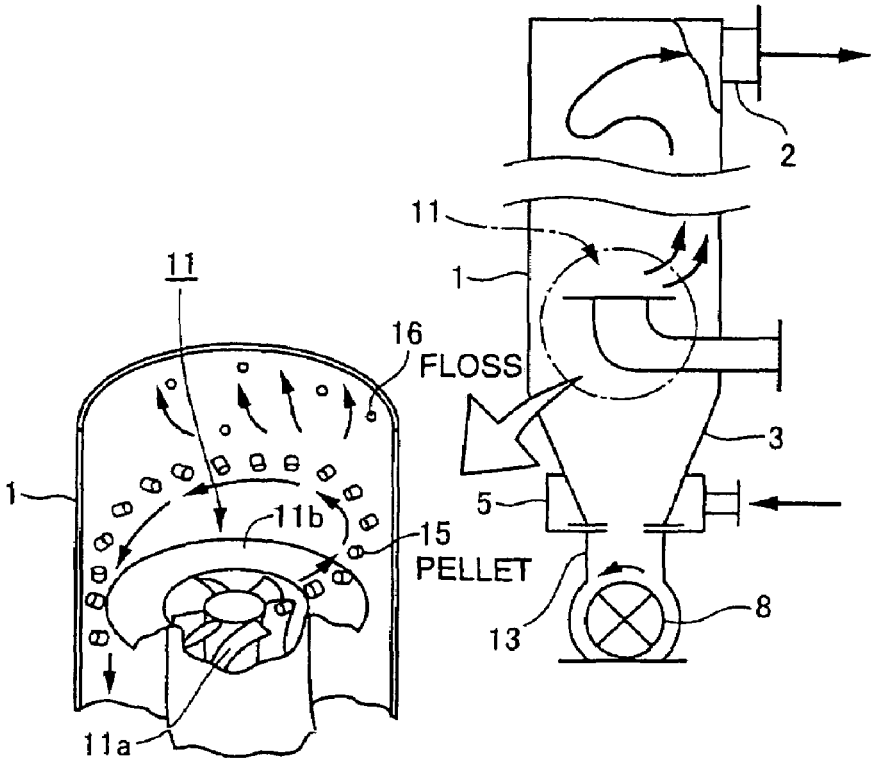
FIG. 2 is an explanatory schematic drawing showing a device according to a second embodiment in which an induction pipe with a spinner is provided in the cylindrical wall as the raw grain feeding unit.
Figure 3:
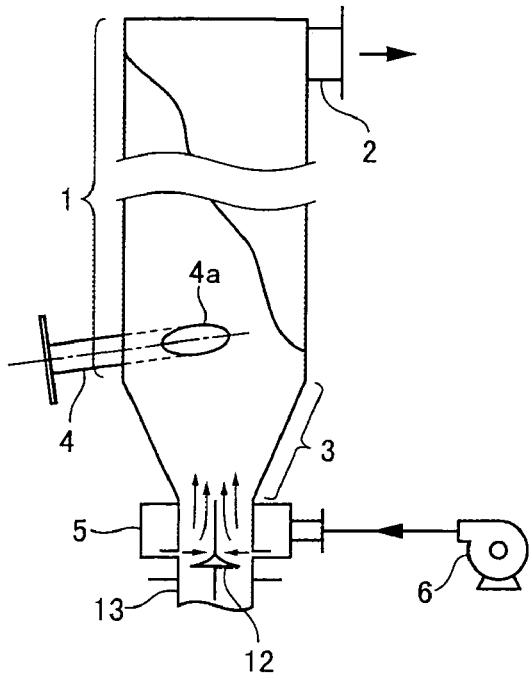
FIG. 3 is an explanatory schematic drawing showing a device according to a third embodiment in which further improvement is made to the first embodiment.

Devices shown in FIG. 1, FIG. 2, and FIG. 3 are devices for performing a method of blowing the secondary air together with the primary air.

Referring first to FIG. 1, a first embodiment in which a tangent induction pipe for blowing the primary air and raw grains is used will be described. An upwardly oriented tangent induction pipe 4 is connected to a cylindrical section 1 having a diameter D so as to open (opening 4*a*) on the inner wall surface thereof. Since the center axis of the induction pipe 4 is connected upwardly in parallel with a tangent line of the inner wall of the cylindrical section 1, an airflow generated by the primary air flow upward while whirling along the inner wall of the pipe. An exhaust pipe 2 is provided on the upper portion of the cylindrical section 1 and a conical section 3 is provided at the lower portion thereof. An exhaust blower 7 is connected to the exhaust pipe 2, and air and lightweight grains are drawn out from the upper portion of the cylindrical section 1 in a suction method. A method of pumping the primary air is also applicable. The tangent induction pipe 4 for sucking air and the raw grains containing the lightweight grains upward along the tangent line of the pipe wall is provided on the cylindrical section 1 in the vicinity of the lower end. The raw grains are supplied from a hopper 10 via a pneumatic transport pipe 9 to the tangent induction pipe 4.

A conical section 3 is disposed at the lower end of the cylindrical section 1. A slit is formed between an opening at the lower end of the conical section 3 and a cylindrical section 13, and the slit is surrounded by a secondary air intake chamber 5. A secondary air blower 6 is connected to the secondary air intake chamber 5, and the secondary air is blown into the container from the entire periphery via the slit. A rotary valve 8 constituting an air rocker discharger is provided at the lower end of the cylindrical section 13. The rotary valve 8 rotates in a hermetical state, and discharges only the raw grains.

The operation of the first embodiment is as follows.

(Primary Separation Step) The raw grains containing the lightweight grains, which are to be separated are supplied from the hopper 10, and introduced into the cylinder in the direction of moving upward while whirling along the inner wall surface of the cylinder together with the primary air taken from the pneumatic transport pipe 9, so that the primary separation step is started. Most of the lightweight substances contained in the raw grains are guided to an exhaust port by the upwardly oriented airflow in the pipe. The raw grains and part of lightweight grains are retained in a certain watershed by frictional resistance with respect to the wall surface caused by whirl and then drop into the conical section 3 on the downside by their own weights.

(Secondary separation Step) Air is blown through the slit into the space of the conical section 3 on the downside toward the raw grains dropping into the conical section on the downside in the primary separation step so as to blow the lightweight grains out of the raw grains upward to the space in the cylindrical section, where the primary separation step is performed.

(Discharging Step) The raw grains with the lightweight grains removed drop further from the lower end of the conical section 3 through the cylindrical section 13, and are taken out continuously from the discharging section from the lower end by the operation of the rotary valve 8.

Referring now to FIG. 2, a second embodiment in which a feeding unit with a spinner is employed for blowing the primary air and the raw grains will be described. The feeding unit is shown as a partly enlarged perspective view. Other structures are the same as the embodiment described above. An induction pipe 11 is disposed below the center of the cylindrical section 1, and releases the raw grains including pellets 15 and flosses 16 so as to whirl upward along the inner wall of the cylindrical section 1. The induction pipe 11 includes a flange 11*b*, and provided at the center is vanes 11*a* for providing rotational components for releasing the raw grains. The pellets 15 drop, but most of the flosses 16 are taken up. The operation of the second embodiment is the same as that of the embodiment described above other than that the induction pipe 11 is employed.

Referring next to FIG. 3, a device according to a third embodiment will be described. The device of the third embodiment is the same as the first embodiment described above, other than that a stabilizer 12 is disposed at the position where the secondary separation step is performed. The secondary air is blown from a secondary air intake chamber 5 onto the bevel of a stabilizer 12 via the slit. The configuration of the stabilizer 12 is the same as that shown in FIG. 4 in an enlarged manner. The flange portion of the stabilizer 12 assists upward feeding of the lightweight grains (flosses). The operation of the device of the present embodiment is the same as the embodiment described above other than that the rate of separation and removal of the floss is improved by introduction of the stabilizer 12.

Figure 4:
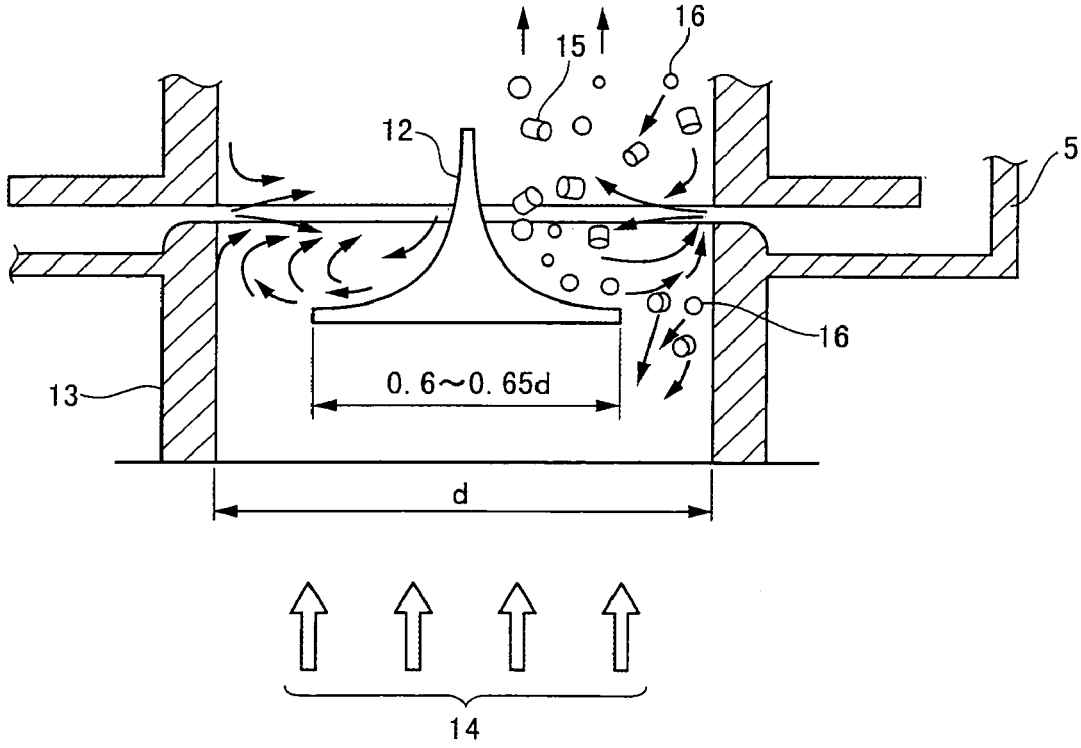
FIG. 4 is an explanatory partial schematic drawing showing a device according to a fourth embodiment in which further improvement is made to the third embodiment.

Referring now to FIG. 4, a device of a fourth embodiment will be described. The device of the fourth embodiment is provided with a tertiary air blowing unit at the cylindrical section 13 below the stabilizer 12 which has been added in the third embodiment described above. In this embodiment, the ratio of the flow rate of the primary air, the secondary air, and the tertiary air is set to 8:1:1. The diameter of the flange of the stabilizer 12 is set to 0.6 to 0.65 d with respect to the cylindrical section 13 having the inner diameter of d. In this manner, dropping flosses 16 are blown upward by blowing tertiary air 14 from below the secondary air blowing unit upward.

The operation of the device of the fourth embodiment is as follows.

(Primary Separation Step) as described above (Secondary separation Step) Air is blown through the slit into the space of the conical section 3 on the downside toward the raw grains dropping into the conical section on the downside in the primary separation step so as to blow the lightweight grains out of the raw grains upward to the space in the cylindrical section, where the primary separation step is performed. In the next tertiary separation step, the lightweight grains which are blown upward are also blown upward to the space in the cylindrical section 1, that is, the space in which the primary separation step is performed.

(Tertiary separation Step) By introducing the tertiary air, lightweight grains 16 dropping from between the flange of the stabilizer 12 and the inner diameter of the cylindrical section on the downside are blown upward. The heavyweight grains drop further downward.

(Discharging Step) In the similar manner as the embodiments described above, the raw grains with the lightweight grains removed drop further from the lower end of the conical section 3 through the cylindrical section 13, and taken out continuously from the discharging section from the lower end by the operation of the rotary valve 8.

In order to compare characteristics between the device of the embodiment described above and the device of the related art, devices A to E are prepared.

Comparative Device A (FIG. 1, secondary air stopped, no stabilizer provided, tertiary air not supplied)

Comparative Device B (FIG. 1, secondary air supplied, no stabilizer provided, tertiary air not supplied) First Embodiment Comparative Device C (FIG. 3, secondary air supplied, stabilizer provided, tertiary air not supplied) Third Embodiment Comparative Device D (FIG. 4, secondary air supplied, stabilizer provided, tertiary air supplied) Fourth Embodiment Comparative Device E (FIG. 2, secondary air not supplied, no stabilizer provided, tertiary air not supplied, corresponding to the second embodiment in FIG. 2 with the secondary air stopped)

In order to inspect the extent of separation between the lightweight grains and the heavyweight grains, material prepared by mixing 50 g of fine ribbons, which correspond to the floss, to 10 kg of pellets is used. The pellet is polycarbonate pellet of 3 mm cube, and fifty pellets correspond to 1 g. The ribbons employed here are formed by cutting black vinyl bag (20 μm in thickness) into pieces of 5 mm in width×10-50 mm in length.

Comparison of Efficiency of Separation

Total amount of air during operation of the device A was 10 $m^3$ per minute, no secondary air was included.

Total amount of air during operation of the device B was 9 $m^3$ per minute, 2.0 $m^3$ per minute was included.

Total amount of air during operation of the device D was 10 $m^3$ per minute, 1 $m^3$ per minute of secondary air and 1 $m^3$ per minute of tertiary air were included.

Total amount of air during operation of the device E was 8.5 $m^3$ per minute, no secondary air was included.

Figures 5, 6:
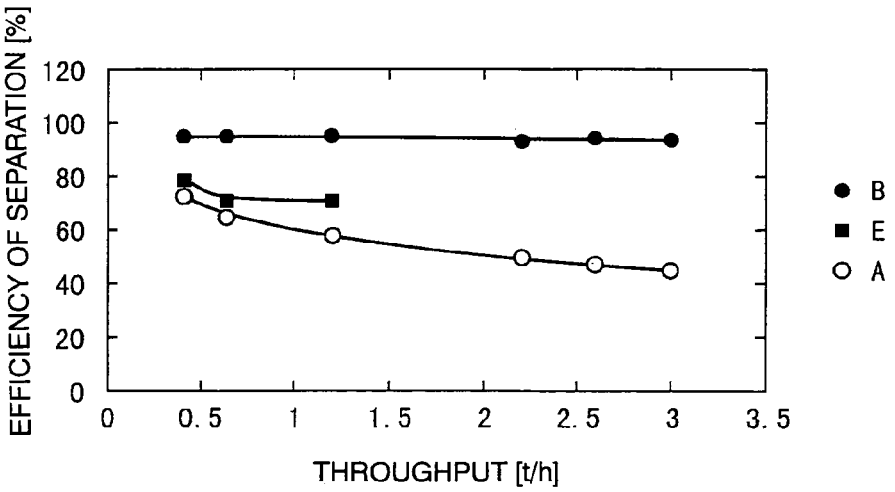
FIG. 5 is a table for comparing the rates of collection of ribbons (flosses) for each device.
FIG. 6 is a graph showing part of the contents of the table in FIG. 5.

FIG. 5 is a table showing the rates of collection of the ribbons per hourly throughput for the device A, B, D, and E, respectively. According to the table, the device A exhibited the rate of collection of 44 to 72% in the entire range. The device B exhibited the rate of collection of 93.4 to 95.5%. The device D exhibited the rate of collection of 100%. The device E exhibited the rate of collection of 52 to 78%, and was superior in characteristic when the throughput is low, but the efficiency of separation outstandingly lowered as the throughput increased, and the operation was disabled when the throughput exceeded 1.5 t per hour. The contents of the table are plotted in FIG. 6.

Subsequently, difference of the efficiencies of separation depending on the difference of mixture ratios of pellet and air (solid-air ratio) was examined about the device C (third embodiment), and the range of the throughput was inspected. FIG. 7 is a table of the efficiency of separation of the ribbon, and FIG. 8 is a table of the fly rate of the pellet. FIG. 9 is a graph of the efficiency of separation of the ribbon, and FIG. 10 is a graph of the fly rate of the pellet. At the airflow of 6 $m^3$ per minute (solid-air ratio 5.13), the device was clogged with the pellets and hence was disabled within an hour. At the airflow of 7 $m^3$ per minute, it was found that the efficiency of separation was 88% and then increased to 95% at the maximum with increase of airflow. However, the amount of flying of the pellets also increased with the airflow.

Referring now to the drawings, a method of separating bran from grain will now be described further in detail. The embodiment described below relates to a method of separating narrow strips of the grains, grains like powder bodies/small grains, and the powder bodies described above (hereinafter, referred to simply as powder bodies and the like) from the grains. In comparison with the method of the related art in which air and grains and powder bodies and the like are sucked (or blow) for separation, the method of the present invention fundamentally employs an additional step of blowing air (secondary air) at the lower position. Furthermore, in order to achieve better separation, a step of blowing air (tertiary air) further from below the secondary air blowing unit is provided.

Figure 11:
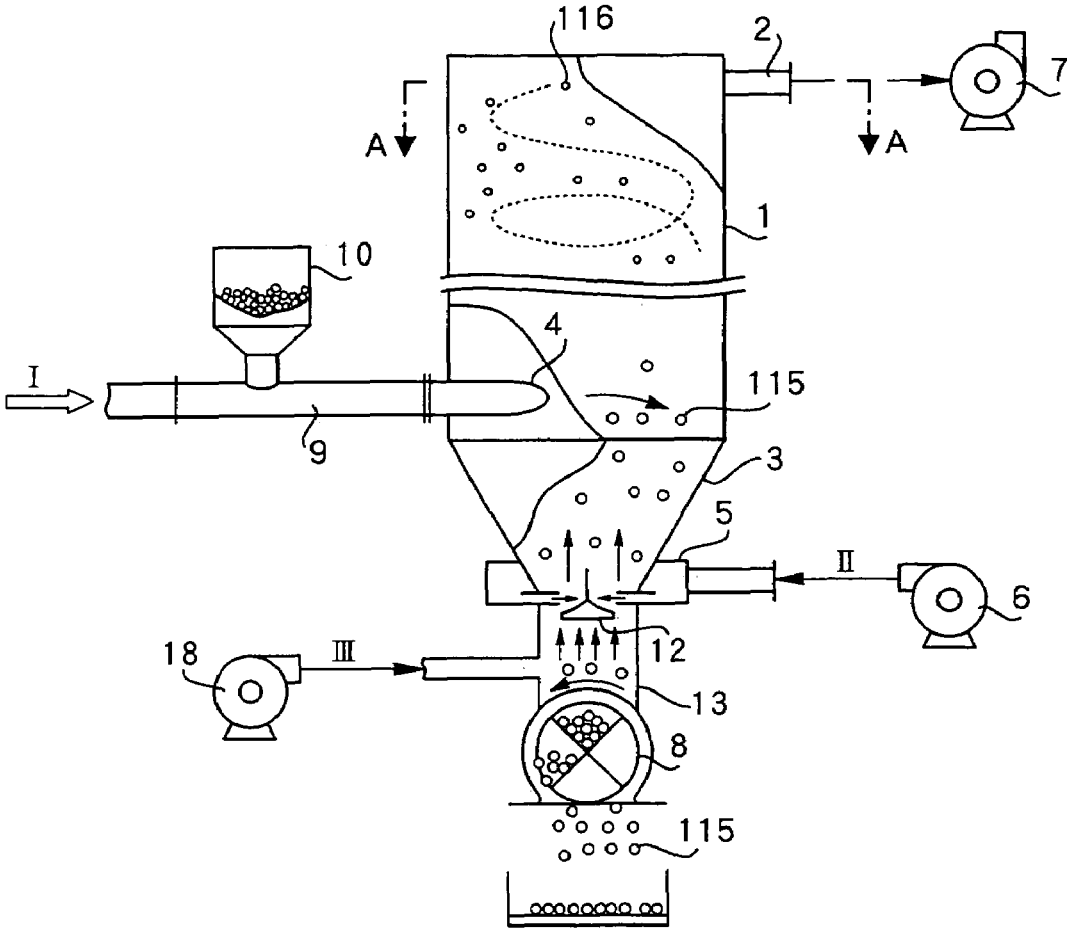
FIG. 11 is a schematic front view of the device according to the embodiment for implementing a method of the present invention.
Figure 12:
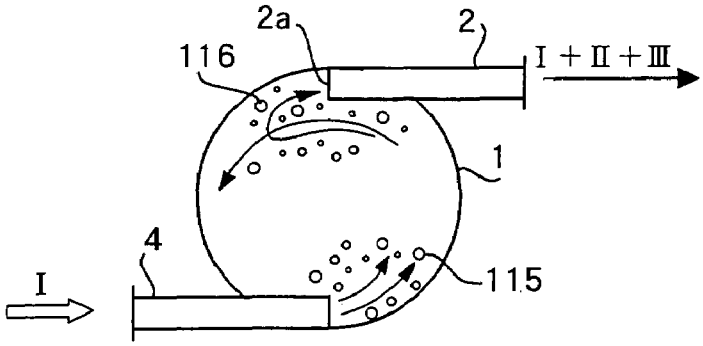
FIG. 12 is a cross-sectional plan view of the device according to the embodiment.
Figure 13:
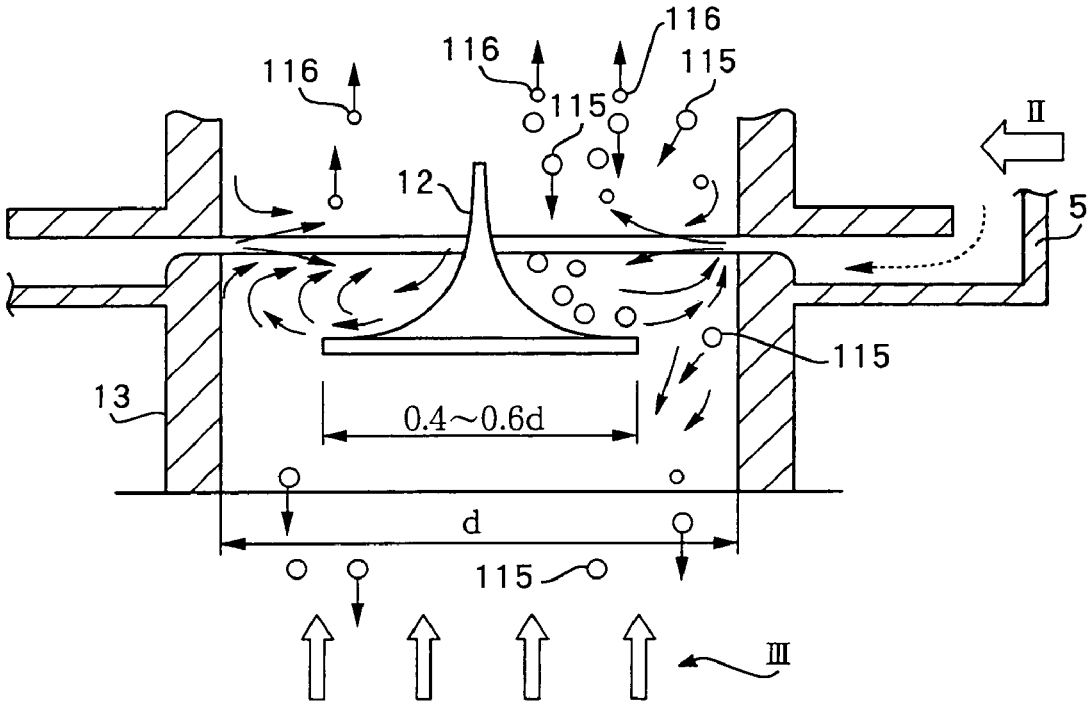
FIG. 13 is an explanatory cross-sectional front view showing relation between blowing of secondary air and blowing of tertiary air.

FIG. 11 is a schematic front view, partly broken for showing the interior structure, of a device according to a fifth embodiment for implementing the method of the present invention. FIG. 12 is a cross-sectional plan view of the device of the fifth embodiment. FIG. 13 is an explanatory cross-sectional front view showing the relation between blowing of the secondary air and blowing of the tertiary air according to the fifth embodiment. The tangent induction pipe 4 is connected to the cylindrical section 1 so as to open on the inner surface of the wall. The induction pipe 4 is connected to the cylindrical section 1 so that the center axis thereof extends horizontally, or slightly downwardly in parallel with the tangent of the inner wall of the cylindrical section 1. Airflow formed by the primary air tends to whirl downward along the pipe wall. Airflow at the center of the cylindrical section 1 moves upward as a whole as a result of employment of an exhaust blower that will be described above and of induction of the secondary air.

The exhaust pipe 2 is provided at the upper portion of the cylindrical section 1, and the conical section 3 is provided at the lower portion thereof. An exhaust blower 7 is connected to the exhaust pipe 2, and air and the powder bodies and the like are drawn out from the upper portion of the cylindrical section 1 in a suction method. A method of pumping the primary air is also applicable. The exhaust pipe 2 opens at the cylindrical section 1 toward the direction opposite from the whirling direction as shown in FIG. 12. The grains containing the powder bodies and the like are supplied from the hopper 10 via the transport pipe 9 to the tangent induction pipe 4.

The conical section 3 is disposed at the lower end of the cylindrical section 1. A slit is formed between the opening at the lower end of the conical section 3 and the cylindrical section 13 on the downside, and the slit is surrounded by the secondary air intake chamber 5. The secondary air is blown from the secondary air intake chamber 5 onto the bevel of the stabilizer 12 via the slit. The configuration of the stabilizer 12 is the same as that shown in FIG. 13 in an enlarged manner. The flange portion of the stabilizer 12 assists upward feeding of the powder bodies and the like. The diameter of the flange of the stabilizer 12 is set to 0.4 to 0.6 d with respect to the cylindrical section 13 having the inner diameter of d. In this manner, dropping powder bodies and the like 116 are blown upward by blowing the tertiary air (III) upward from below the secondary air blowing unit. A tertiary air blower 18 is disposed at the cylindrical section 13 below the stabilizer 12.

The secondary air blower 6 is connected to the secondary air intake chamber 5, and the secondary air is blown into the container from the entire circumference via the slit. The rotary valve 8 constituting an air rocker discharger is provided at the lower end of the cylindrical section 13. The rotary valve 8 rotates while maintaining air-tightness and discharges only the grains.

The operation of the device according to the fifth embodiment is as follows.

(Primary separation step) The grains containing the powder bodies and the like which are to be separated are supplied from the hopper 10 via the transport pipe 9, and introduced into the interior of the cylindrical section 1 together with the sucked primary air (I). The grains containing the powder bodies and the like introduced into the cylindrical section 1 are introduced horizontally, or slightly downwardly along the inner wall surface of the cylinder as shown in FIG. 12, and the primary separation step is started. In the cylinder portion 1, an upward airflow is formed at the center by introduction of the above-described primary air (I), and the secondary air (II) and the tertiary air (III). Part of the grains and most part of the powder bodies and the like mixed in the grains are conducted to an entrance opening 2*a* of the exhaust pipe 2 by the upward airflow at the center of the pipe. The grains drop to the conical section 3 on the downside by their own weights.

(Secondary separation Step) Air is blown through the slit into the space of the conical section 3 on the downside toward the grains dropping into the conical section 3 on the downside in the primary separation step so as to blow the powder bodies and the like remaining in the grains upward to the space in the cylindrical section, where the primary separation step is performed.

(Tertiary separation Step) By introducing the tertiary air (III), the powder bodies and the like 116 dropping from between the flange of the stabilizer 12 and the inner diameter of the cylindrical section 13 are blown upward. The grains drop further downward.

(Discharging Step) In a similar manner to the embodiments described above, grains 115 with the powder bodies and the like removed drop further from the lower end of the conical section 3 through the cylindrical section 13, and are taken out continuously from the discharging section from the lower end by the operation of the rotary valve 8.

As shown in FIG. 12, the exhaust pipe 2 is opened toward the direction opposite from the whirling direction in the cylindrical section 1. Therefore, the powder bodies and the like having smaller inertia are drawn through the exhaust pipe 2. A significant amount of grains are carried to the upper portion of the cylindrical section 1, but they are hardly discharged from the exhaust pipe 2.

The inventor has prepared a comparative device having an opening of the exhaust pipe 2 oriented in the whirling direction and conducted an experiment. Then, it was found that the grains are discharged together with the powder bodies even though the quantity is small. However, the device configured as in the embodiment described above, the amount of grains discharged together with the powder bodies and the like was reduced to 1/10 to 1/20. The comparative device and the device of the embodiment were operated with the amounts of air shown below.

Primary air (I) 3.5 $m^3$

Secondary air (II) 1.25 $m^3$

Tertiary air (III) 1.25 $m^3$

Figure 14:
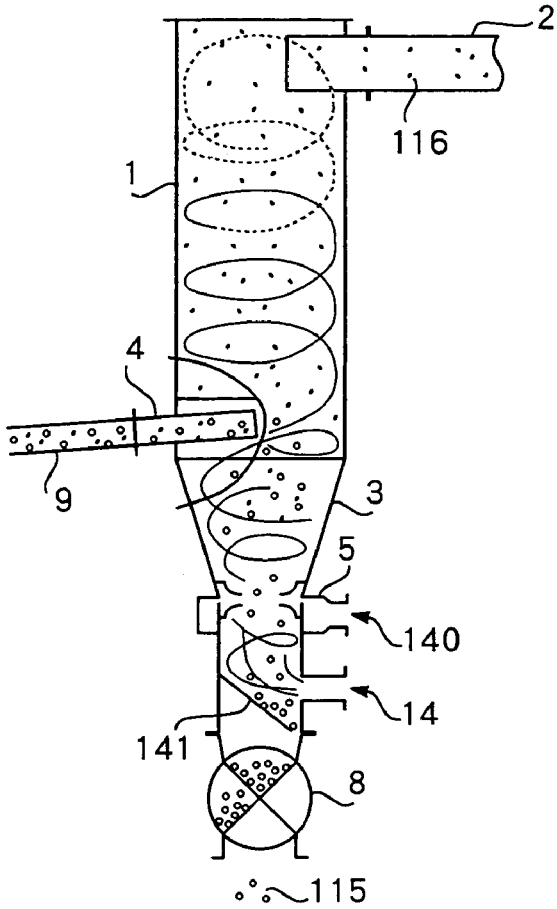
FIG. 14 is an explanatory schematic cross-sectional view for the device according to a fifth embodiment.
Figure 15:
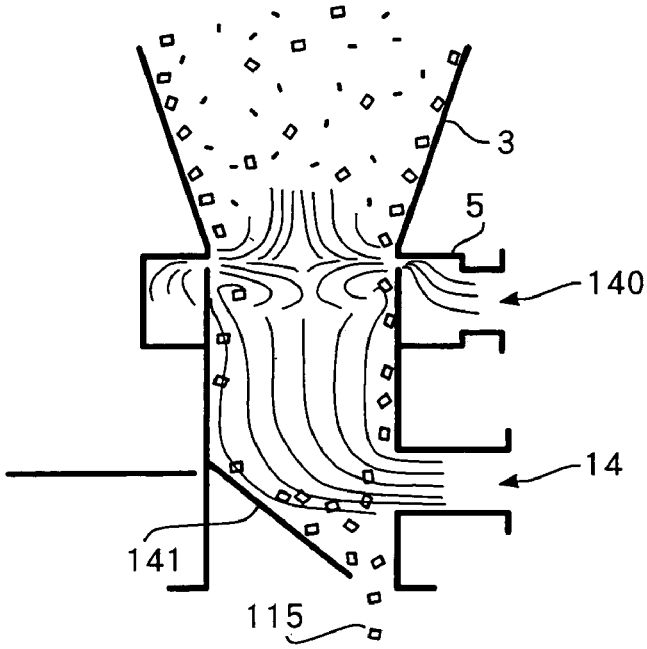
FIG. 15 is an enlarged cross-sectional view showing the blowing portion of the secondary air and the tertiary air of the device according to the fifth embodiment.

FIG. 14 is a schematic front view of a device according to a sixth embodiment for implementing the method of the present invention. FIG. 15 is an explanatory cross-sectional front view showing the relation between blowing of the secondary air and blowing of the tertiary air of the sixth embodiment.

The tangent induction pipe 4 opening on the inner wall surface of the cylindrical section 1 and the direction of rotation of the air and grains in the exhaust pipe 2 are the same as those described in conjunction with the fifth embodiment referring to FIG. 12. In other words, the exhaust pipe 2 opens at the cylindrical section 1 toward the direction opposite from the whirling direction, as shown in FIG. 12. The grains containing the powder bodies and the like are supplied from the hopper 10 via the transport pipe 9 to the tangent induction pipe 4.

The induction pipe 4 is connected to the cylindrical section 1 so that the center axis thereof extends in parallel with the tangent of the inner wall thereof horizontally or slightly upwardly. Airflow formed by the primary air tends to whirl substantially horizontally, or upwardly along the inner wall of the pipe. By introducing the secondary air, airflow at the center of the cylindrical section 1 moves upward as a whole.

The present embodiment is the same as the embodiment described above in that the cylindrical section 1 is provided with the exhaust pipe 2 at the upper portion, and the conical section 3 is provided at the lower portion. However, in the present embodiment, the stabilizer is not used. As shown in FIG. 15, a secondary air 140 is blown from the entire circumference of the lower end of the conical section 3 upward the center, and is moved upward by the tertiary air 14 which is blown from below. A guide plate 141 is provided below the intake port of the tertiary air 14. The guide plate 141 guides the tertiary air upward.

Figure 16:
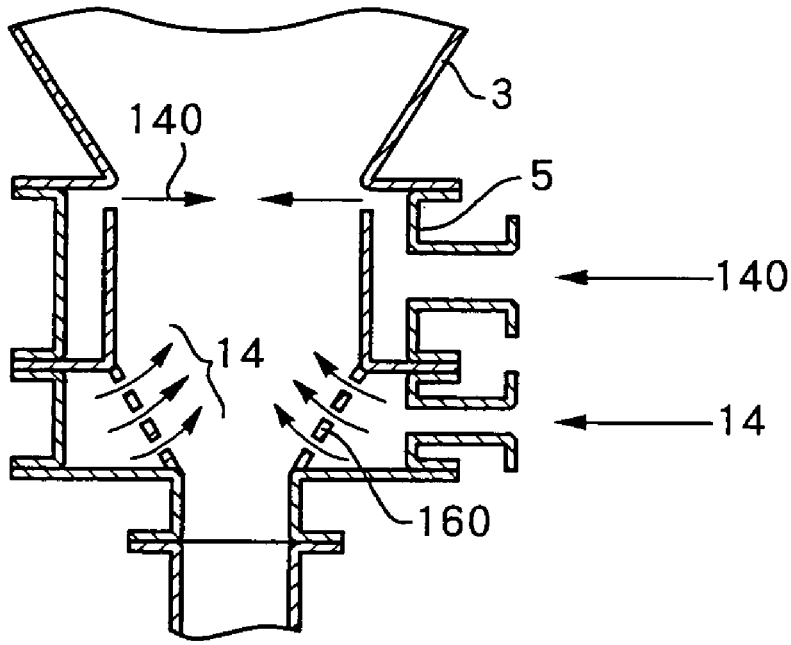
FIG. 16 is a cross-sectional view of a modification of the blowing portions of the secondary air and the tertiary air of the device according to the fifth embodiment.
Figure 17:
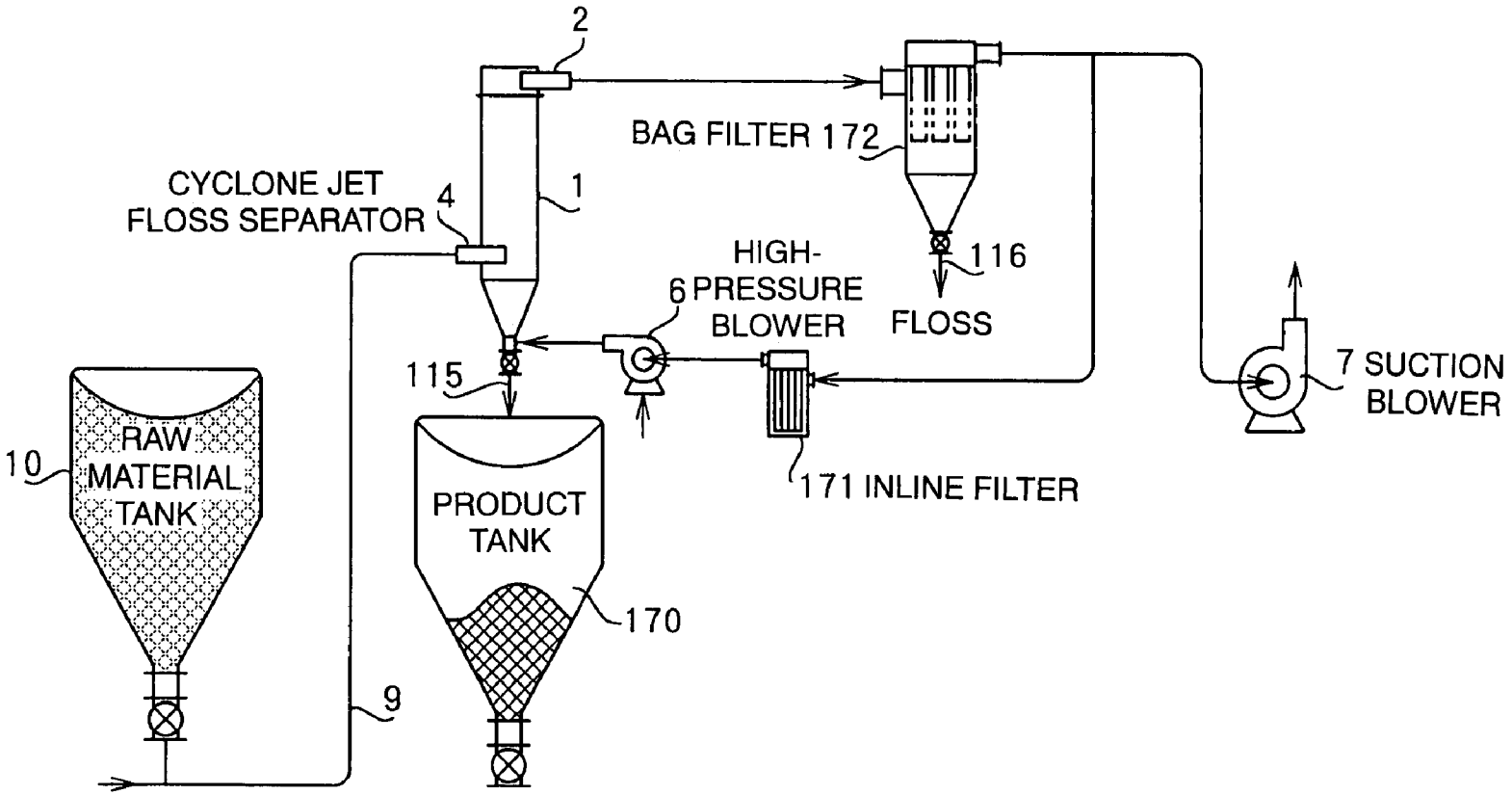
FIG. 17 is a system block diagram showing an example in which a sixth embodiment (blowing portion in FIG. 5) is used.

FIG. 16 is a cross-sectional view showing a modification of the secondary air and the tertiary air blowing portion of the device according to the sixth embodiment. A number of holes are formed on the wall surface of a conical section 160 below the secondary air blowing portion, so that the tertiary air is blown upward therefrom. The operation of the device according to the sixth embodiment is substantially the same as that of the device according to the fifth embodiment. However, the operational efficiency is outstandingly improved.

Subsequently, description will be made referring to the system block diagram showing an example in which the sixth embodiment is used (the blowing portion in FIG. 5 is employed). The pellets with the flosses supplied from the hopper (material tank) 10 is introduced into the cylindrical section 1 via the transport pipe 9 and the tangent induction pipe 4. Flosses 116 separated and blown upward (see FIG. 14) are collected by a bag filter 172 being sucked by the exhaust blower (suction blower) 7. The exhaust air from the bag filter 172 is supplied by the secondary air blower (high-pressure blower) 6 as the secondary and the tertiary air through an inline filter 171. When the length of the transport pipe 9 from the hopper (material tank) 10 is long and the pressure at the opening of the tangent induction pipe 4 is in the order of 10 KPa, the secondary and the tertiary air can be sucked from the atmospheric air without using the secondary air blower (high-pressure blower) 6 described later.

Figure 18:
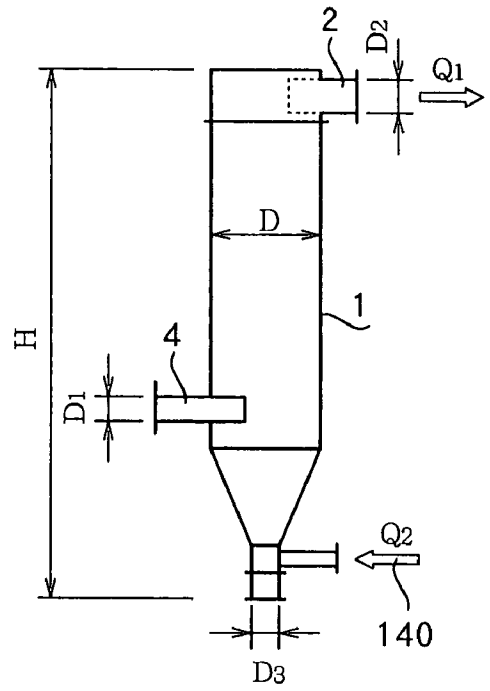
FIG. 18 is a graph showing various specifications of the sixth embodiment (blowing portion in FIG. 5)
Figure 19:
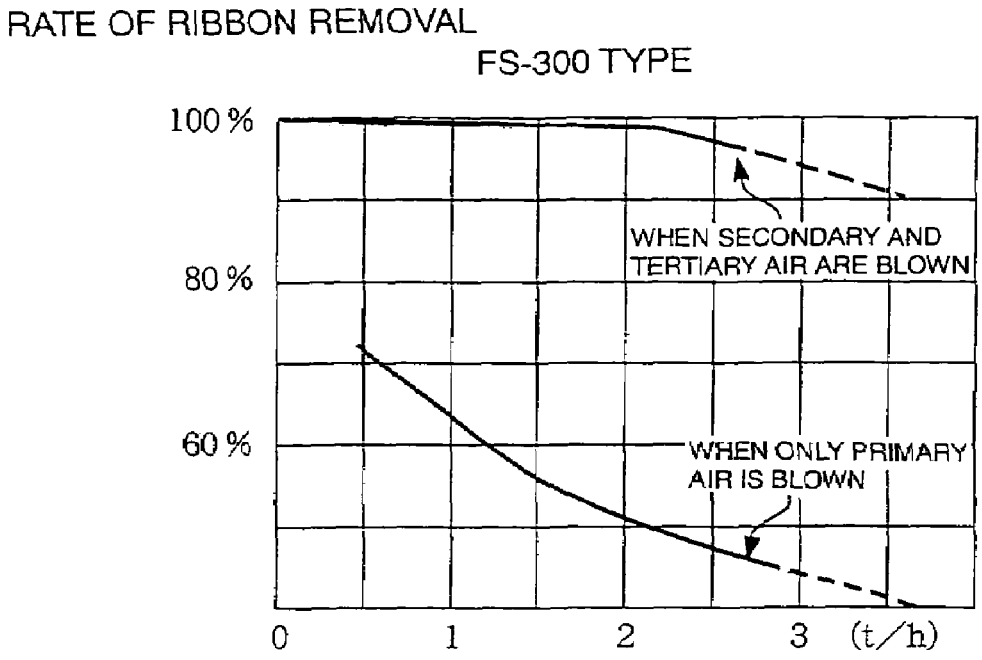
FIG. 19 is a drawing showing an operational characteristic of the FS-300 according to the sixth embodiment.

FIG. 18 is a graph showing various specifications of the device according to the sixth embodiment (blowing portion in FIG. 5). Referring to FIG. 19, the operational characteristics of the FS-300 type with the specifications shown below.

Diameter of the cylindrical section D=300 mm

Diameter of the primary air blowing pipe $D_1$=65 mm

Diameter of the exhaust pipe $D_2$=100 mm

Diameter of the discharge pipe $D_3$=125 mm

Height of the device H=1400 mm

Amount of exhaust air $Q_1$=9 $m^3$/min

Amount of secondary and tertiary air $Q_2$=3.2 $m^3$/min

Throughput=1150-2300 Kg/h

As shown in FIG. 19, about 100% of the flosses can be removed up to 2000 Kg/h of throughput. When the secondary and the tertiary air were not used, that is, only with the primary air, the rate of removal was in the order of 70% even when the throughput was significantly low.

Subsequently, the operational characteristic of the FS-500 type with high throughput will be described referring to FIG. 20. The specifications of FS-500 are as follows.

Diameter of the cylindrical section D=500 mm

Diameter of the primary air blowing pipe $D_1$=100 mm

Diameter of exhaust air $D_2$=180 mm

Diameter of the discharge pipe $D_3$=200 mm

Height of the device H=2200 mm

Figure 20:
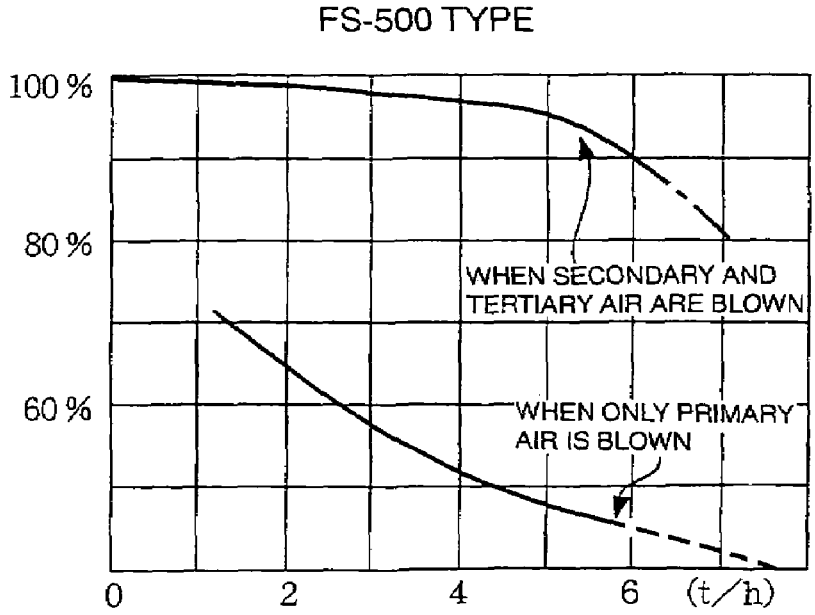
FIG. 20 is a drawing showing an operational characteristic of the FS-500 according to the sixth embodiment.
Figure 21:
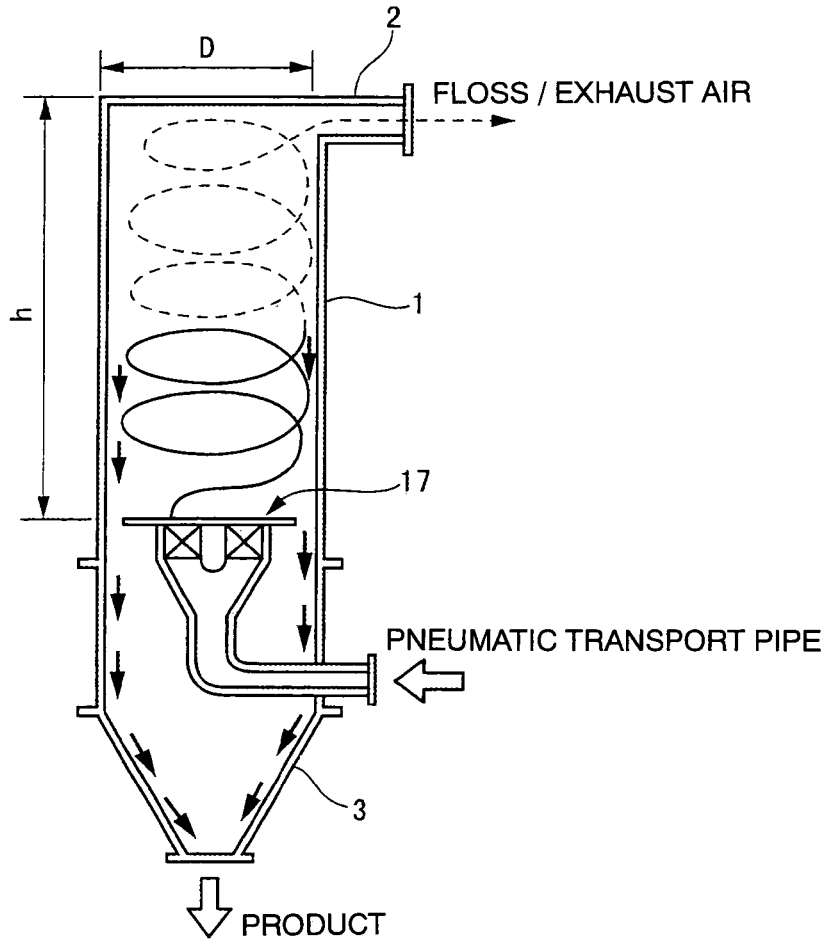
FIG. 21 is an explanatory schematic drawing of a device in the related art.

Amount of exhaust air $Q_1$=25 $m^3$/min
Amount of secondary and tertiary air $Q_2$=8.8 $m^3$/min
Throughput=3000-6000 kg/h As shown in FIG. 20, about 100% of the flosses can be removed up to 1 t/h of throughput. The rate of removal was 90% up to 6 t/h of throughput.

According to the present invention, by blowing the secondary air and performing the secondary separation step, the efficiency of separation and collection of the lightweight grains and the like may be improved in comparison with the device in the related art. Removal of the flosses is possible without employing the stabilizer as shown in the sixth embodiment. In this case, adjustment of the tertiary air is important. In addition, by blowing the tertiary air and performing the tertiary separation step, 100% of the floss could be collected. The efficiency of the secondary separation step can be improved by employing the stabilizer.

By blowing the secondary air and performing the secondary separation step, the efficiency of separation and collection of the powder bodies and the like may be improved in comparison with the device in the related art. The efficiency of the secondary separation step can be improved by employing the stabilizer. In addition, by blowing the tertiary air and performing the tertiary separation step, the powder bodies and the like could be separated completely.

Various modifications may be made to the embodiments described above in detail within the scope of the present invention. The mixing ratio of the primary air, the secondary air, and the tertiary air may be selected as appropriate depending on the object and the amount.

What is claimed is:

1. A method of separating unwanted lightweight grains from raw grains using a vertical cylinder having, in order from the top, an exhaust port, a cylindrical primary separation space, a conical secondary separation space, a tertiary separation space, and an unloading port, comprising:

a primary separation step of introducing raw grains containing the lightweight grains, which are to be separated, together with primary air into the cylindrical primary separation space in a direction to allow the raw grains to whirl upward in a whirling motion along an inner wall surface of the cylindrical primary separation space, so that most of the lightweight grains contained in the raw grains are guided to the exhaust port by upwardly flowing air in the cylindrical primary separation space and the raw grains and part of the lightweight grains stay in a predetermined flow area by frictional resistance with respect to the inner wall surface generated by the whirling motion and then are dropped into the conical secondary separation space by their own weight;

a secondary separation step of blowing secondary air to a lower portion of the conical secondary separation space through a slit toward an upwardly beveled surface of a stabilizer provided centrally in the lower portion of the conical secondary separation space, and toward the raw grains dropping into the conical secondary separation space from the primary separation step so as to blow lightweight grains in the raw grains upward to the cylindrical primary separation space;

a tertiary separation step of blowing tertiary air upward from below the conical secondary separation space to blow remaining lightweight grains to the conical secondary separation space;

a discharging step of taking the raw grains with the lightweight grains removed continuously out from the unloading port provided below the conical secondary separation space; and an exhaust step of continuously exhausting primary, secondary, and tertiary air having the lightweight grains toward a horizontal tangential direction from an upper portion of the primary separation space.

2. The method of claim 1, wherein in the primary separation step, the primary air is introduced into the cylindrical primary separation space in a tangential direction, and the exhaust port is arranged in an opposite direction to the tangential direction.

3. A device for separating unwanted lightweight grains from raw grains, comprising:

a cylindrical section comprising a peripheral wall defining an exhaust port at an upper portion thereof;

a conical section provided below the cylindrical section;

a raw grain feeding unit for feeding raw grains together with primary air into the cylindrical section to whirl the raw grains upward along an inner periphery of the cylindrical section above the conical section;

a lightweight grain separating unit for taking air having the lightweight grains in the raw grains out from the upper portion of the cylindrical section through the exhaust port, the lightweight grain separating unit extending horizontally and tangentially from the exhaust port;

a secondary air blowing unit for blowing the secondary air toward the raw grains being dropped from the cylindrical section upward at a lower portion of the conical section to move fine grains upward to the cylindrical section wherein the secondary air blowing unit blows a high-speed fresh secondary airflow into a chamber that surrounds a slit formed between an upwardly beveled surface of a stabilizer and a lower end of the conical section, wherein at least a portion of the upwardly beveled surface of the stabilizer is located below the slit; and a tertiary air blowing unit blowing tertiary fresh air upward from below the conical section into a chamber bounded by the stabilizer and a unit for discharging separated heavier raw grains away from the stabilizer.

4. A device according to claim 3, wherein the secondary air blowing unit comprises a secondary air intake chamber connected via a slit provided at the lower end of the conical section for taking compressed air therefrom.

5. A device for separating unwanted powder bodies from grains comprising:

a cylindrical section forming a primary separation space, the cylindrical section comprising a peripheral wall having an opening;

an exhaust pipe extending horizontally and tangentially from the opening for discharging air with the powder bodies at an upper portion thereof;

a conical section forming a secondary separation space provided on a downside of the cylindrical section;

a grain feeding unit for feeding grains together with primary air containing the powder bodies into the cylindrical section from a lower port of the cylindrical section so as to whirl in the cylindrical section in a direction along an inner periphery of the cylindrical section;

a secondary air blowing unit for blowing high-pressure air at a lower portion of the conical section from a circumferential slit on the conical section toward the grains containing the powder bodies being dropped from the cylindrical section on an upwardly beveled surface of a stabilizer to move the powder bodies upward to the cylindrical section, wherein at least a portion of the upwardly beveled surface of the stabilizer is located below the circumferential slit;

a tertiary air blowing unit for blowing tertiary fresh air into a tertiary separation space provided below the secondary separation space; and a unit for discharging the grains from under the tertiary separation space.

6. A device according to claim 5, wherein the secondary air blowing unit has a secondary air intake chamber surrounding the slit that blows a high-speed secondary airflow through the slit toward an upwardly beveled surface of a stabilizer provided at a lower end of the conical section.

* * * * *